United States Patent [19]

George

[11] 4,104,604

[45] Aug. 1, 1978

[54] NARROWLY KNAULED END CAP FOR AN ELECTRIC FUSE

[75] Inventor: Delbert L. George, Salem, N.H.

[73] Assignee: Gould Inc., Newburyport, Mass.

[21] Appl. No.: 819,061

[22] Filed: Jul. 26, 1977

[51] Int. Cl.[2] ..... H01H 85/02

[52] U.S. Cl. ..... 337/248; 337/186

[58] Field of Search ..... 337/186, 187, 201, 205, 337/248, 414, 415

[56] References Cited

U.S. PATENT DOCUMENTS

| | | | |
|---|---|---|---|
| 348,049 | 8/1886 | Perkins | 337/186 |
| 2,017,490 | 10/1935 | Glowacki | 337/248 |
| 3,529,270 | 9/1970 | Kozacka | 337/248 X |
| 4,063,208 | 12/1977 | Bernatt | 337/248 |

*Primary Examiner*—George Harris
*Attorney, Agent, or Firm*—Erwin Salzer

[57] ABSTRACT

An electric fuse having a pultruded casing of polyester resin including an outermost ply of woven glass cloth and an innermost ply of woven glass cloth and at least one intermediate ply of non-woven glass fiber mat. The casing of the fuse supports at the ends thereof a pair of ferrules which are press-fitted. The axially inner ends of said ferrules form narrowly knurled cones, and the knurled area encompasses the entire periphery of the axially inner ends of said ferrules rather than spaced points thereof.

4 Claims, 3 Drawing Figures

NARROWLY KNAULED END CAP FOR AN ELECTRIC FUSE

BACKGROUND OF THE INVENTION

U.S. Pat. No. 3,979,709 to Daniel P. Healey, Jr. 09/07/76 discloses a fuse having a multiply casing of a synthetic-resin-glass-cloth laminate. The casing is produced by the pultrusion process and comprises at least three plies of different materials, namely an outermost ply and an innermost ply both of woven glass cloth and one or more intermediate plies of non-woven glass fiber mat. The above patent describes several such composite materials including more than three plies. One of the advantages of this material as fuse tube material lies in the combination of a high dynamic strength with an unusal degree of flexibility or elasticity. The above flexibility or elasticity is due to the presence of one or more layers of non-woven glass fiber mat with its relatively great interstices between individual fibers. As a result of the great elasticity of pultruded fuse tube materials of the above kind, the above patent suggested a process of affixing fuse caps or ferrules by a rolling and staking process. This way of fastening caps or ferrules to fuse tubes is adequate for many instances but does not involve the maximum of holding force which may be imparted to caps or ferrules mounted on a casing or fuse tube of the kind referred-to above. This problem is solved by the present invention.

SUMMARY OF THE INVENTION

Fuses embodying the present invention include a casing of electric insulation, a fusible element arranged therein and a granular arcquenching filler embedding said fusible element. The casing comprises an outermost and an innermost ply of woven glass cloth, and at least an intermediate ply of glass fiber mat. Said plies overlap in a direction longitudinally of said casing as set forth in considerable detail in the above referred-to U.S. Pat. No. 3,979,709. The various layers of the lay-up are integrated into a laminate by a suitable resin, preferably a polyester resin. A pair of ferrules is press-fitted on the ends of said casing. The axially inner ends of said ferrules are narrowly knurled frustums of cones, the knurled area encompassing the entire periphery of said axially inner ends of said ferrules rather than merely spaced points thereof.

DESCRIPTION OF PREFERRED EMBODIMENT

Figure 1:
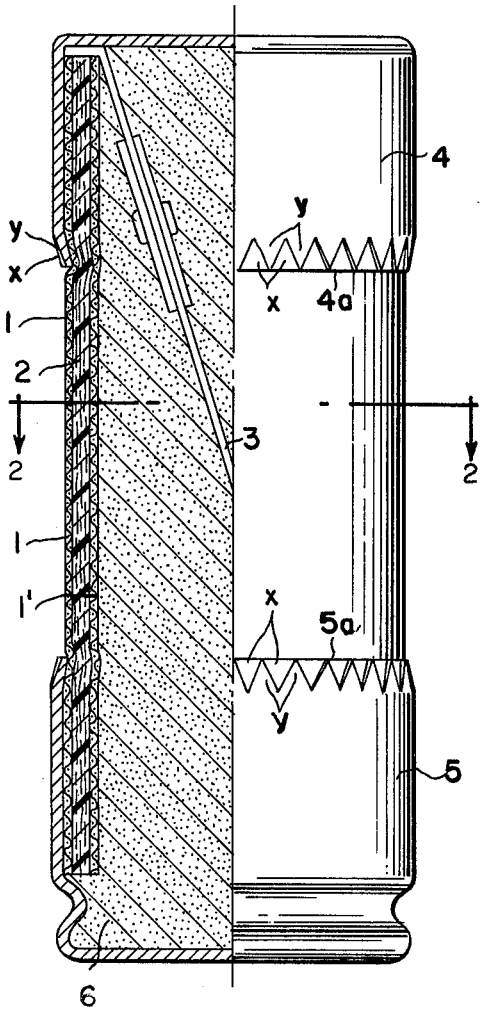
FIG. 1 is partly a longitudinal section and partly an elevational view of a fuse embodying this invention.
Figure 3:
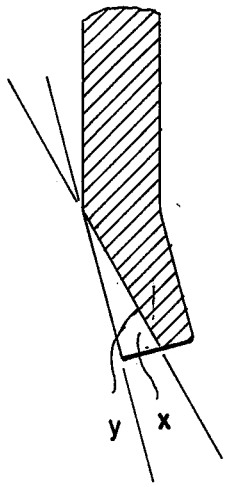
FIG. 3 is a longitudinal section along the axially inner end of a fuse cap or ferrule.
Figure 2:
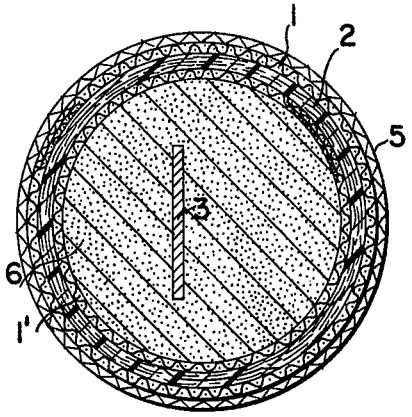
FIG. 2 is a cross-section along 2—2 of FIG. 1.

Referring now to the drawings, numerals 1 and 1' have been applied to indicate the outermost and the innermost ply of a tubing which are of woven fiber glass cloth. Layer 2 of fiber glass mat is sandwiched between layers 1 and 1'. The longitudinal edges of layers 1,1' and 2 overlie in a direction longitudinally of casing 1,1',2. Plies or layers 1,1' and 2 are integrated by cured polyester resin to form a laminate. Fusible element 3 is arranged inside of casing 1,1',2 and its ends are bent over the edges or rims of casing 1,1',2 and blind soldered to the insides of ferrules 4,5. Casing 1,1', 2 is filled with a granular arc-quenching filler 6 which embeds fusible element 3. The ferrules 4,5 have axially inner ends *4a, 5a* which are in the form of narrowly serated or knurled frustums of cones. The knurled area encompasses the entire periphery of said axially inner ends of said pair of ferrules rather than spaced points thereof. In other words, the knurled area encompasses 360°. The knurled area includes narrowly alternating points wherein the ductile matal of said ferrules 4,5 penetrates to a greater and to a smaller depth into said laminate 1,1',2 forming the casing thereof. The points of greater penetration have been designated by *x* and the points of lesser penetration have been designated by *y*.

It will be apparent that the points of greater penetration *x* are of substantially triangular shape.

Ferrule 5 is affixed in the same way to casing 1,1',2 as ferrule 4, but distinguishes from the former by a rejection groove *5a* in it.

I claim as my invention:

1. An electric fuse comprising (a) a tubular casing of electric insulation;

(b) a fusible element inside said casing;

(c) a granular arc-quenching filler embedding said fusible element;

(d) said casing comprising an outermost and an innermost ply of woven glass cloth and at least one intermediate ply of nonwoven glass fiber mat, each of said plies overlapping in a direction longitudinally of said casing, and said casing further comprising a polyester resin integrating said plies into a laminate; and (e) a pair of ferrules press-fitted on the ends of said casing and conductively interconnected by said fusible element, said pair of ferrules being shaped at the axially inner ends thereof to form narrowly knurled frustums of cones, the knurled area encompassing the entire periphery of said axially inner ends of said pair of ferrules rather than spaced points thereof.

2. An electric fuse as specified in claim 1 wherein said knurled area includes narrow alternating points wherein the metal of said ferrules penetrates to a greater and to a smaller depth into said laminate.

3. An electric fuse comprising a tubular casing of electric insulation; a fusible element inside said casing; a pulverulent arc-quenching filler surrounding said fusible element; said casing being formed by a laminate including an outermost ply and an innermost ply both of woven glass cloth and at least one intermediate ply of non-woven fiber glass mat, each of said plies overlapping in a direction longitudinally of said casing, said casing further comprising a polyester resin integrating said plies into a laminate, and a pair of ferrules press-fitted on the ends of said casing and conductively interconnected by said fusible element, wherein the novel feature consists in that said pair of ferrules are shaped at the axially inner ends thereof to form narrowly knurled frustums of cones, the knurled area encompassing the entire periphery of said axially inner ends of said pair of ferrules and including narrowly spaced points wherein the penetration of the metal of said pair of ferrules into said laminate alternates.

4. An electric fuse as specified in claim 3 wherein the points of greater penetration of the metal of said pair of ferrules into said laminate are substantially triangular.

* * * * *